US009126725B1

(12) United States Patent
Laible

(10) Patent No.: US 9,126,725 B1
(45) Date of Patent: Sep. 8, 2015

(54) CONTAINER INSERT FOR USE WITH A CLOSED LOOP SYSTEM

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 14/288,446

(22) Filed: May 28, 2014

(51) Int. Cl.
*B65D 47/00* (2006.01)
*B65D 47/06* (2006.01)
*B65D 25/50* (2006.01)

(52) U.S. Cl.
CPC ..... *B65D 47/06* (2013.01); *B65D 25/50* (2013.01)

(58) Field of Classification Search
CPC ..... B65D 47/06; B65D 25/48; B65D 25/58
USPC ..... 222/544, 554, 555, 563, 567, 569, 570; 215/53, 341
See application file for complete search history.

(56) References Cited

U.S. PATENT DOCUMENTS

| | | | | |
|---|---|---|---|---|
| 2,849,163 | A * | 8/1958 | Soffer et al. | 222/402.22 |
| 5,445,186 | A * | 8/1995 | Richter et al. | 137/614.2 |
| 6,612,545 | B1 * | 9/2003 | Rutter et al. | 251/149.6 |
| 6,669,062 | B1 * | 12/2003 | Laible | 222/464.1 |
| 7,631,783 | B1 * | 12/2009 | Laible | 222/153.04 |
| 7,686,194 | B2 * | 3/2010 | Kasting | 222/549 |
| 8,066,157 | B2 * | 11/2011 | Laible | 222/453 |
| 8,511,639 | B2 * | 8/2013 | Johnson | 251/149.6 |
| 2014/0263156 | A1 * | 9/2014 | Newsom et al. | 215/258 |

* cited by examiner

*Primary Examiner* — Lien Ngo
(74) *Attorney, Agent, or Firm* — Dennis L. Thomte; Thomte Patent Law Office LLC

(57) ABSTRACT

An insert for use with a closed loop system, a dispensing system, a gravity draining system or other systems. The insert is designed to be inserted into the throat of a container such as a bottle. The insert includes a cylindrical seal which has a hardness which is less than the other components of the insert. The seal compensates for varying inside diameters of the throat of the container. The seal may be overmolded into a cylindrical recess formed in the insert or may be separately molded and then positioned in the cylindrical recess.

9 Claims, 5 Drawing Sheets

CONTAINER INSERT FOR USE WITH A CLOSED LOOP SYSTEM

BACKGROUND OF THE INVENTION

1. Field of the Invention

This invention relates to a container insert for use with a closed loop system. More particularly, this invention relates to an insert which includes an improved soft seal which enables the insert to be inserted into the throat of a container such as a bottle to positively sealably engage the inside surface of the bottle throat.

2. Description of the Related Art

Container inserts or plugs are used in closed loop systems such as disclosed in U.S. Pat. Nos. 5,958,546; 6,142,345; and 6,968,983. The container inserts of the above closed loop systems are press-fitted downwardly into the throat of a container such as a bottle. The inserts of the prior art sealably embrace the inside surface of the throat of the bottle. The inserts of the prior art are designed to be received within the throat of the bottle which has a specified inside diameter. If the inside diameter of the throat of the bottle is greater than the specified inside diameter, it is possible that the liquid within the bottle may leak out around the insert. Further, when the inside diameter of the throat of the bottle exceeds the specified inside diameter, the "pull-out" force to pull the insert from the throat of the bottle will be lessened which could cause the insert to be inadvertently pulled from the throat of the bottle thereby creating a chemical spill.

If the inside diameter of the throat of the bottle is less than the specified inside diameter, it will be difficult to insert the insert into the throat of the bottle. Forcing the insert into the throat of the bottle may stretch the throat thereby possibly resulting in a leak situation. Further, the forcing of the insert into the throat of a bottle having an inside diameter less than the specified diameter may cause a tearing or scratching of the insert resulting in an improper seal between the insert and the inside surface of the throat. Additionally, even if the inside diameter of the throat of the bottle is within the specified inside diameter specification of the throat of the bottle, there may be an imperfection in the inside surface of the throat of the bottle which could result in a leak situation being present.

It is believed that some persons working in the closed loop systems art have formed an O-ring groove in the outer surface of the insert and placed an O-ring therein. One problem with using an O-ring in an O-ring groove formed in the insert is that the O-ring may roll partially out of the O-ring groove during insertion of the insert into the throat of the bottle thereby resulting in an imperfect seal. Further, the O-ring is sometimes torn or damaged during the insertion process.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A container insert is provided for use with a closed loop system wherein the insert is mounted in the throat of a container such as a bottle. The insert of this invention may also be used for dosing systems or gravity draining systems. The primary purpose of the insert is to control the evacuation of the contents of the container. The insert of this invention includes a horizontally disposed ring-shaped rim or lip having an upper side, a lower side, an outer end and an inner end.

A cylindrical first wall member having an upper end, a lower end, an inner surface, and an outer surface, extends downwardly from the inner end of the lip whereby the lip protrudes outwardly from the upper end of the first wall member. The lip engages the upper end of the throat of the bottle to limit the downward movement of the insert with respect to the throat of the bottle.

A downwardly and inwardly tapered shoulder is provided at the lower end of the first wall member. A second wall member, having an upper end and an open lower end, extends downwardly from the lower end of the shoulder. The open lower end of the second wall member has internal threads formed therein. A tubular member having upper and lower ends is positioned within the first and second wall members. The lower end of the tubular member is fixed to the second wall member.

The lip, first wall member, shoulder, second wall member and the tubular member are injection molded with a polypropylene plastic material having a first hardness.

The outer surface of the first wall member has a cylindrical recess formed therein. A resilient seal is positioned in the cylindrical recess. The resilient seal may be overmolded into the cylindrical recess or separately molded and slipped onto and into the cylindrical recess. The seal has an upper end, a lower end, an inner side and an outer side. The resilient seal is comprised of a low-density polyethylene plastic material which is overmolded into the cylindrical recess in the outer surface of the first wall member after the other parts of the insert have been injection molded. The outer surface of the seal is curved downwardly and inwardly. The low-density polyethylene seal has a hardness which is less than the hardness of the first hardness. In other words, the seal is softer than the other components of the insert.

When the insert is inserted into the throat of a container, the low-density polyethylene seal yieldably engages the inside surface of the throat of the bottle to positively prevent any leakage therearound and which compensates for throat inside diameters which may vary from the specified inside diameter. The tapered shoulder at the lower end of the first wall assists in the insertion of the insert into the throat of the bottle. The seal also increases the "pull-out" resistance of the insert from the bottle and further retains the insert in the throat of the bottle.

It is therefore a principal object of the invention to provide an improved insert for use with a closed loop system.

It is a further object of the invention to provide an overmolded insert for use with a closed loop system, a dosing system or a gravity draining system.

A further object of the invention is to provide an insert which has a seal provided thereon which has a hardness less than the hardness of the other components of the insert.

A further object of the invention is to provide an insert for use with a closed loop system which compensates for varying inside diameters of the throat of a bottle.

A further object of the invention is to provide an insert for use with a closed loop system which is easily and securely inserted into the throat of a container.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
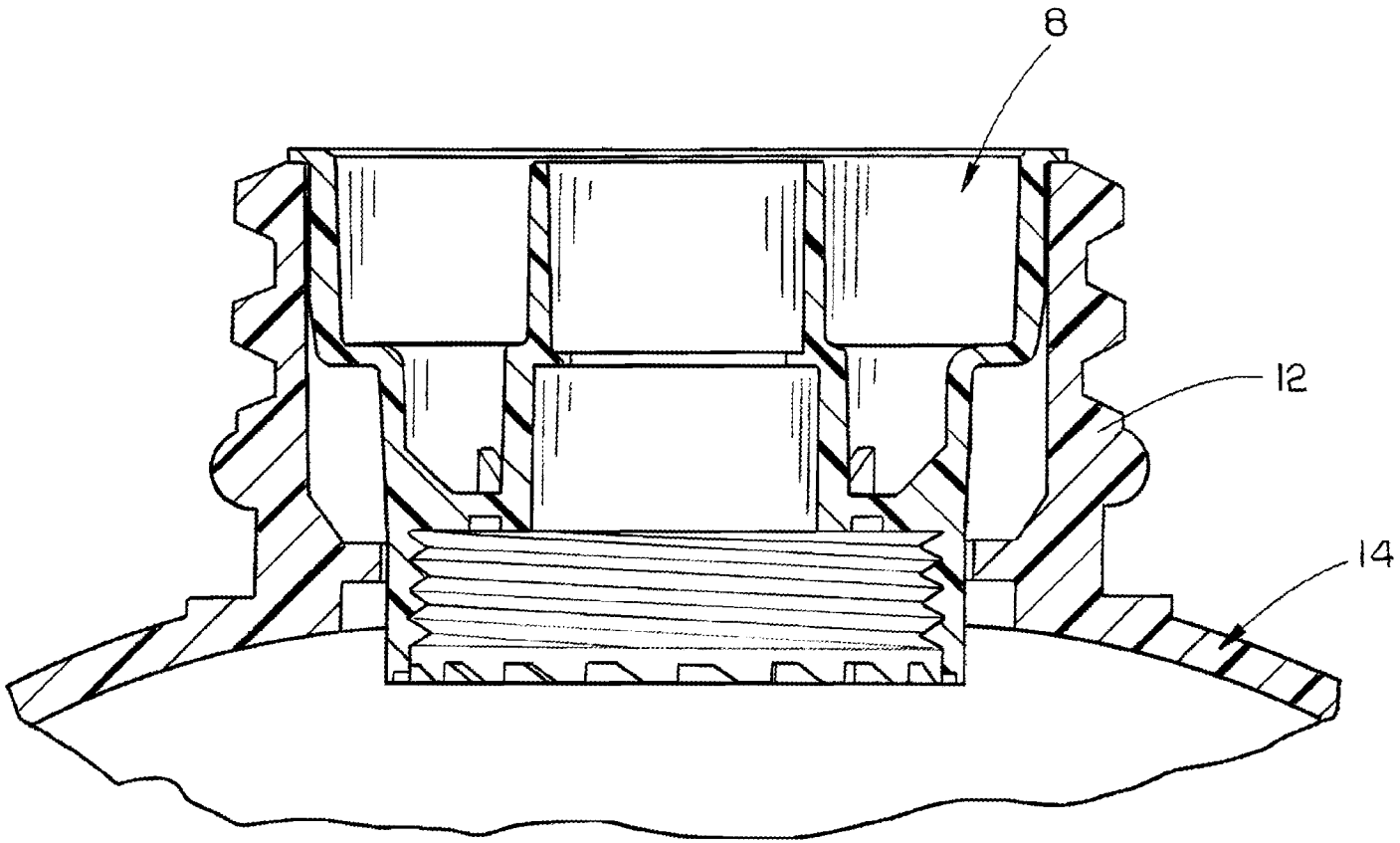
FIG. 1 (PRIOR ART)
FIG. 1 is a sectional view illustrating a prior art insert inserted into the throat of a container.
Figure 2:
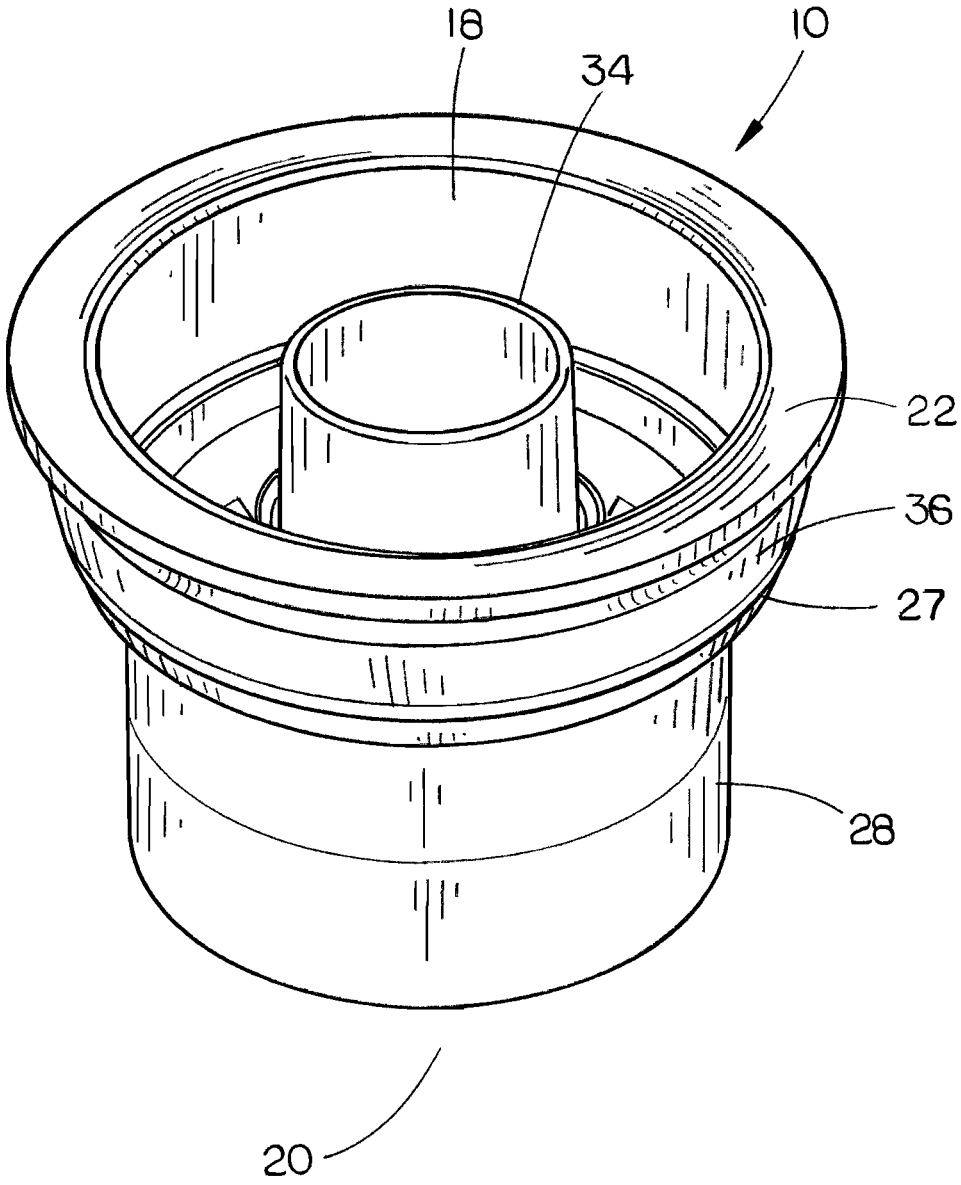
FIG. 2 is a perspective view of the insert of this invention.
Figure 3:
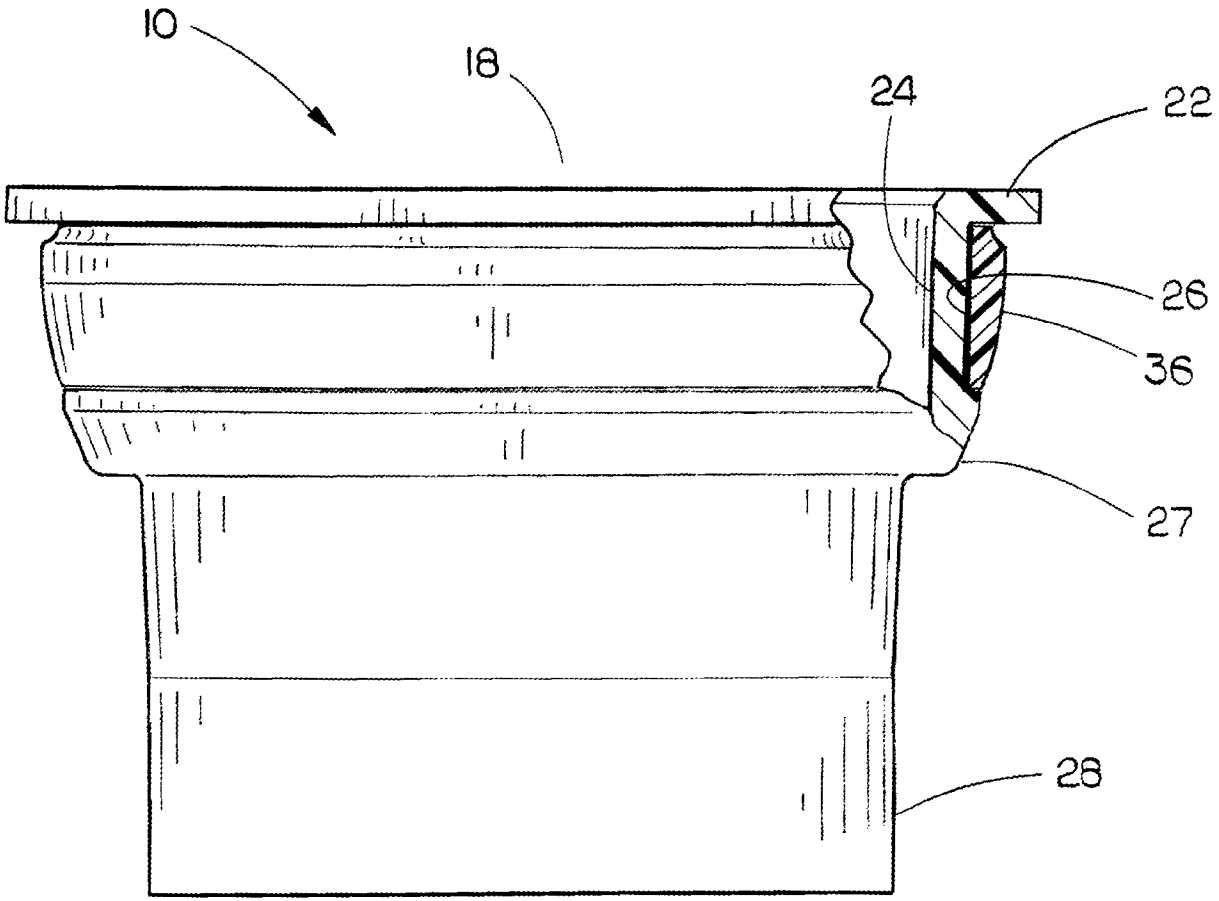
FIG. 3 is a side view of the insert of this invention with a portion thereof cutaway to more fully illustrate the invention.
Figure 4:
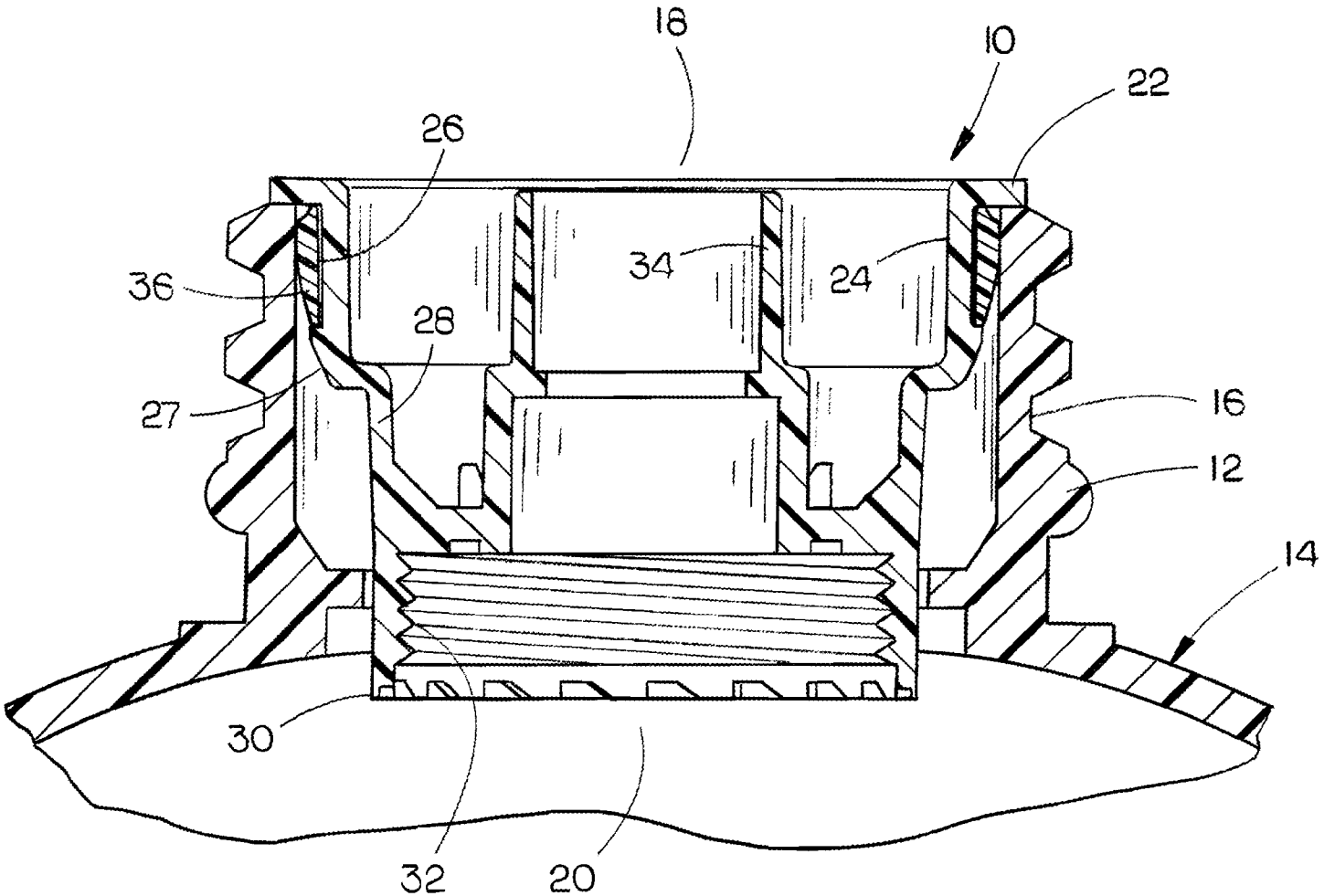
FIG. 4 is a sectional view illustrating the insert of this invention inserted into the throat of a container.
Figure 5:
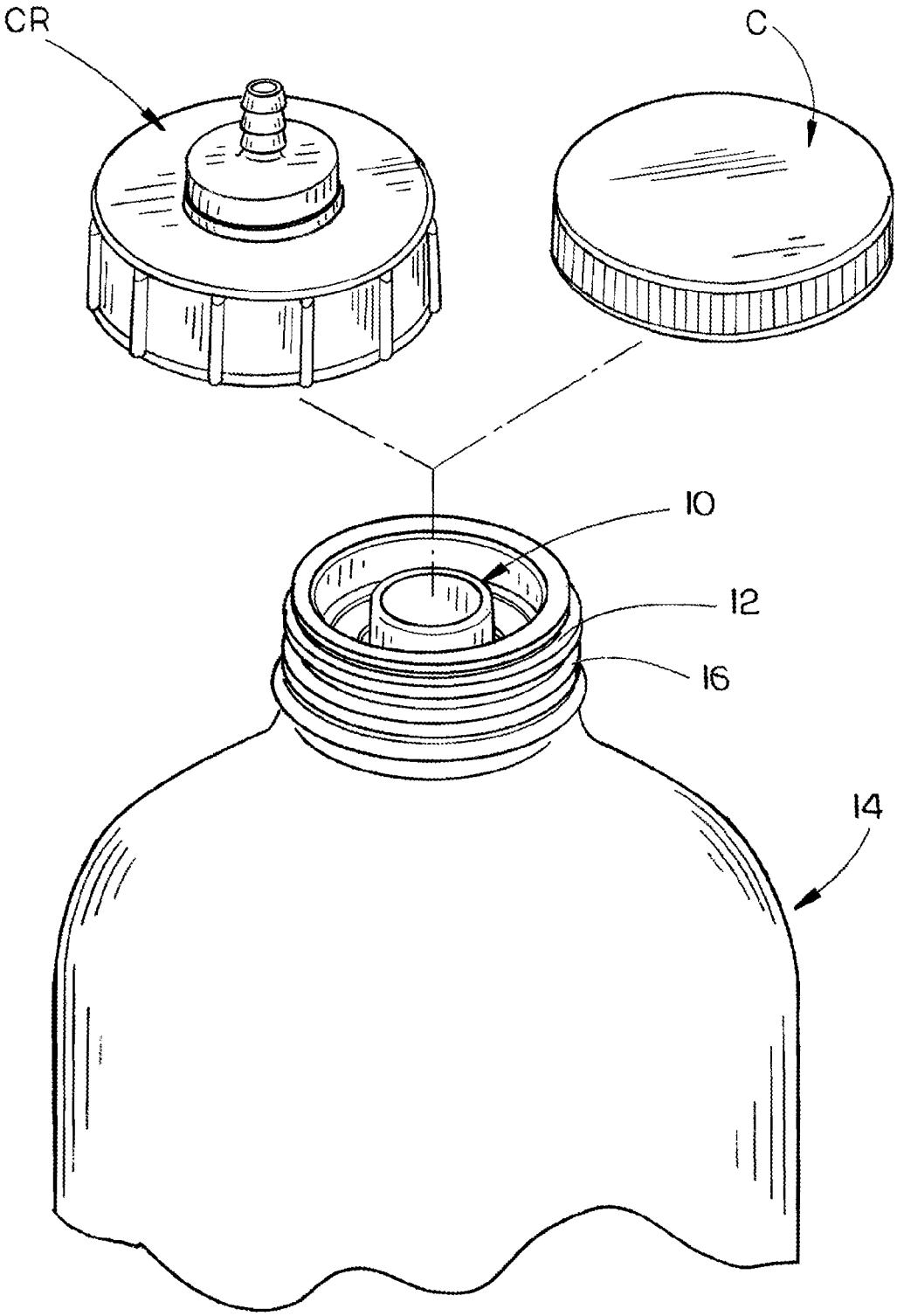
FIG. 5 is a partial perspective view illustrating the insert of this invention inserted into the throat of a container.

In FIG. 1, Applicant's earlier container insert or plug is referred to by the reference numeral 8. In Applicant's instant invention, the container insert or plug 10 is shown in FIGS. 2-5.

Applicant's earlier U.S. Pat. Nos. 5,958,546; 6,142,345; and 6,968,983 are incorporated herein by reference thereto to complete this disclosure if necessary.

The container insert 10 of this invention is press-fitted into the throat 12 of a container 14, such as a bottle or the like. Normally, throat 12 includes external threads 16. A shipping cap C may be threaded onto the external threads 16 to close the container 14. A collar receiver CR may also be threaded onto the threads 16 when the contents of the container are to be evacuated. Container insert 10 includes an open upper end 18 and an open lower end 20. Insert 10 includes a ring-shaped upper flange or lip 22, which limits the downward insertion of the insert 10 into the container 14. A first cylindrical wall member 24 extends downwardly from the inner end of lip 22. The outer surface of wall member 24 has a cylindrical recess 26 formed therein.

The lower end of wall member 22 has an inwardly and downwardly tapered shoulder 27 formed therein. Wall member 28 extends downwardly from the lower inner end of shoulder 27. Wall member 28 has a lower end 30. The insert 10 has internal threads 32 formed at the lower end for reception of a portion of a closed loop system such as shown in the above-identified patents. The disclosures in the above-identified patents are incorporated herein by reference thereto to complete this disclosure if necessary.

Insert 10 also has a central tubular portion 34 extending upwardly from the inside of the wall member 28, as seen in the drawings. The tubular portion 34 serves a purpose such as disclosed in the above-identified patents.

The components of the insert 10 just described are comprised of a polypropylene material by means of an injection molding process. The polypropylene plastic material of the insert has a specific durometer or hardness. The numeral 36 refers to a plastic seal, gasket, etc. which is positioned in the recess 26. The resilient seal 36 may be overmolded into the cylindrical recess 26 or separately molded and then slipped onto and into the cylindrical recess 26. Preferably, the seal 36 is comprised of a low-density polyethylene plastic material. As seen, the outer side of seal 36 tapers downwardly and inwardly from its upper end. The seal 36 may be overmolded onto the insert 10 after the other components of the insert have been injection molded. The seal 36, if separately molded, may be slipped onto and into the recess 26. The durometer or hardness of seal 36 is less than the hardness of the other components of the insert so that the seal 34 is slightly flexible or is softer than the other components of the insert.

The insert 10 is inserted downwardly into the throat 12 of the container 14 with the tapered shoulder 27 enhancing the downward insertion of the insert 10 into the throat 12 of the container. The flexible soft seal 36 engages the inside surface of the throat 12 of the container 14 even if the inside diameter of the throat 12 is somewhat larger than the specified inside diameter. Further, if the inside diameter of the throat 12 is smaller than the specified inside diameter, the seal 36 will compress somewhat since it is of a less hard material than the remainder of the insert. The flexible seal 36 will also seal any imperfections in the inside surface of the throat 12. Not only does the seal 36 enhance the leak prevention aspects of the insert 10 but also increases the amount of "pull-out" force required to pull the insert 10 from the throat 12 of the container.

Although the insert 10 is designed for use with a closed loop dispensing system, the insert 10 could be used with dosing systems, gravity draining systems, etc.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An insert for use with a closed loop system including a container having a throat with an inside surface, comprising:

a horizontally disposed ring-shaped lip having an upper side, a lower side, an outer end, and an inner end;

a cylindrical first wall member having an upper end, a lower end, an inner surface and an outer surface;

said first wall member extending downwardly from said inner end of said lip whereby said lip protrudes outwardly from said upper end of said first wall member;

an annular shoulder, having inner and outer ends, at said lower end of said first wall member;

a second wall member, having an upper end and an open lower end, extending downwardly from said inner end of said shoulder;

said open lower end of said second wall member having internal threads formed therein;

a tubular member having upper and lower ends;

said tubular member being positioned within said first and second wall members;

said lower end of said tubular member being fixed to second wall member;

said lip, said first wall member, said shoulder, said second wall member and said tubular member being injection molded with a plastic material having a first hardness;

said outer surface of said first wall member having a cylindrical recess formed therein;

and a seal having an upper end, a lower end, an inner side and an outer side;

said seal being comprised of a plastic material which is positioned in said cylindrical recess in said outer surface of said first wall member after the other parts of the insert have been injected molded;

said outer surface of said seal being downwardly and inwardly curved;

said seal being comprised of a plastic material which has a hardness less than the said first hardness.

2. The insert of claim 1 wherein said shoulder is downwardly and inwardly tapered.

3. The insert of claim 1 wherein said seal is comprised of a low density polyethylene material and wherein the other parts of the insert are comprised of a polypropylene material.

4. The insert of claim 1 wherein said seal is overmolded into said cylindrical recess.

5. An insert for use with a liquid container having a throat with an inside surface, comprising:

a horizontally disposed ring-shaped lip having an upper side, a lower side, an outer end, and an inner end;

a cylindrical first wall member having an upper end, a lower end, an inner surface and an outer surface;

said first wall member extending downwardly from said inner end of said lip whereby said lip protrudes outwardly from said upper end of said first wall member;

an annular shoulder, having inner and outer ends, at said lower end of said first wall member;

a second wall member, having an upper end and an open lower end, extending downwardly from said inner end of said shoulder;

said open lower end of said second wall member having internal threads formed therein;

a tubular member having upper and lower ends;

said tubular member being positioned within said first and second wall members;

said lower end of said tubular member being fixed to said second wall member;

said lip, said first wall member, said shoulder, said second wall member and said tubular member being injection molded with a plastic material having a first hardness;

said outer surface of said first wall member having a cylindrical recess formed therein;

and a seal having an upper end, a lower end, an inner side and an outer side;

said seal being comprised of a plastic material which is positioned in said cylindrical recess in said outer surface of said first wall member after the other parts of the insert have been injected molded;

said seal being comprised of a plastic material which has a hardness less than the said first hardness.

6. The insert of claim 5 wherein said shoulder is downwardly and inwardly tapered.

7. The insert of claim 5 wherein said seal is comprised of a low density polyethylene material and wherein the other parts of the insert are comprised of a polypropylene material.

8. The insert of claim 5 wherein said outer surface of said seal is downwardly and inwardly curved.

9. The insert of claim 5 wherein said seal is overmolded into said cylindrical recess.

* * * * *